US008555763B2

(12) United States Patent
Farid et al.

(10) Patent No.: US 8,555,763 B2
(45) **Date of Patent: *Oct. 15, 2013**

(54) SECTIONING DEVICE AND METHOD OF USE

(76) Inventors: Tariq Farid, Cheshire, CT (US); Kamran Farid, Chesire, CT (US)

( * ) Notice: Subject to any disclaimer, the term of this patent is extended or adjusted under 35 U.S.C. 154(b) by 48 days.

This patent is subject to a terminal disclaimer.

(21) Appl. No.: 12/818,330

(22) Filed: Jun. 18, 2010

(65) Prior Publication Data

US 2010/0313724 A1 Dec. 16, 2010

Related U.S. Application Data

(63) Continuation-in-part of application No. 12/248,347, filed on Oct. 9, 2008, now Pat. No. 8,495,941.

(51) Int. Cl.
*B26D 5/08* (2006.01)

(52) U.S. Cl.
USPC ..... 83/620; 83/630; 83/633; 83/932; 30/114; 30/299; 30/302

(58) Field of Classification Search
USPC ..... 30/113.1–113.3, 114, 299, 301–303; 83/932, 620, 627, 630, 633; 99/537–539, 554, 314–316
See application file for complete search history.

(56) References Cited

U.S. PATENT DOCUMENTS

| | | | |
|---|---|---|---|
| 98,457 | A | 12/1869 | Wright |
| 182,133 | A | 9/1876 | Rogers |
| 419,722 | A | 1/1890 | Siersdorfer |
| 471,158 | A | 3/1892 | Westerman |
| 507,383 | A | 10/1893 | O'Connell |
| 590,129 | A | 9/1897 | Bulette |
| 609,368 | A | 8/1898 | Lawson |
| 853,796 | A | 5/1907 | Imes |
| 1,250,676 | A | 12/1917 | Segerc |
| 1,399,950 | A | 12/1921 | Fish |
| 1,422,066 | A | 7/1922 | Vafiades et al. |
| 1,438,925 | A | 12/1922 | Lawrence |
| 1,479,369 | A | 1/1924 | Chounis |
| 1,744,422 | A | 1/1930 | Taylor |
| D108,326 | S | 2/1938 | Grow |
| 2,373,781 | A | 4/1945 | Richardson |
| 3,060,838 | A | 10/1962 | Priore |
| 3,468,355 | A | 9/1969 | Hall |
| 3,830,151 | A | 8/1974 | Gerson |

(Continued)

FOREIGN PATENT DOCUMENTS

| | | |
|---|---|---|
| GB | 319497 | 9/1929 |
| GB | 2286110 | 8/1995 |
| GB | 2312613 | 11/1997 |
| WO | 93/10948 | 6/1993 |

*Primary Examiner* — Phong Nguyen

(57) ABSTRACT

A sectioning device including a frame having a cutter deck with an opening disposed therethrough; a removable insert having an opening disposed therethrough, the removable insert positioned above the opening of the cutter deck such that the opening of the removable insert and the opening of the cutter deck are concentrically aligned; a cutter removably positioned on the removable insert; a press assembly positioned on the frame for pushing an item against and through the cutter; and an activator moving at least one of the cutter and the press assembly between a neutral position and a sectioning position in a single continuous motion, the press assembly and the cutter configured such that the item is sectioned upon movement from the neutral position to the sectioning position.

4 Claims, 7 Drawing Sheets

(56) References Cited

U.S. PATENT DOCUMENTS

| | | | |
|---|---|---|---|
| 3,924,501 | A | 12/1975 | Cohen et al. |
| 4,436,025 | A | 3/1984 | Jones |
| 4,573,384 | A | 3/1986 | Jones |
| D298,790 | S | 12/1988 | Hutchinson |
| 4,911,045 | A | 3/1990 | Mendenhall |
| 5,018,419 | A | 5/1991 | Omura |
| 5,142,973 | A | 9/1992 | Tur et al. |
| 5,337,480 | A | 8/1994 | Codikow |
| 5,363,756 | A | 11/1994 | Muro |
| 5,373,781 | A | 12/1994 | Knasel |
| 5,421,249 | A | 6/1995 | Repisky et al. |
| 5,520,105 | A | 5/1996 | Healy |
| 5,873,294 | A | 2/1999 | Sciuto |
| 6,748,854 | B2 | 6/2004 | Barnard |
| 7,073,260 | B2 * | 7/2006 | Jensen ..... 30/113.3 |
| 2003/0079616 | A1 | 5/2003 | Barnard |
| 2007/0044619 | A1 | 3/2007 | Farid et al. |

* cited by examiner

SECTIONING DEVICE AND METHOD OF USE

CROSS-REFERENCE TO RELATED APPLICATIONS

This application is a continuation-in-part of U.S. patent application Ser. No. 12/248,347 filed on Oct. 9, 2008, which claims the benefit of U.S. Provisional Application Ser. No. 61/025,538 filed Feb. 1, 2008, the entire contents of which are hereby incorporated by reference.

BACKGROUND

1. Field

The disclosed subject matter is generally directed to the cutting of food and non-food items and is more specifically directed to a device for sectioning such food and non-food items into desired shapes.

2. Related Art

It is well known that food items such as fruit can be cut or sectioned by a knife. Utilization of knives to cut or section food items can be time consuming, physically exhausting and dangerous. Previous attempts to overcome these downfalls have resulted in devices that are large, cumbersome, and often not easily portable. Furthermore, the devices are often still physically exhausting and dangerous when placed into use.

Accordingly, the inventors recognize that a need exists for an improved apparatus and method for cutting or sectioning food or non-food items.

SUMMARY

According to one aspect illustrated herein, there is provided a sectioning device comprising: a frame having a cutter deck with an opening disposed therethrough; a removable insert having an opening disposed therethrough, the removable insert positioned above the opening of the cutter deck such that the opening of the removable insert and the opening of the cutter deck are concentrically aligned; a cutter removably positioned on the removable insert; a press assembly positioned on the frame for pushing an item against and through the cutter; and an activator moving at least one of the cutter and the press assembly between a neutral position and a sectioning position in a single continuous motion, the press assembly and the cutter configured such that the item is sectioned upon movement from the neutral position to the sectioning position.

According to other aspects illustrated herein, there is provided a method of sectioning an item with a sectioning device, the method comprising: positioning an item to be sectioned between a cutter and a press assembly of a sectioning device, the cutter positioned on a removable insert positioned above an opening of a cutter deck of the sectioning device; moving at least one of the cutter and the press assembly between a neutral position and a sectioning position in a single continuous motion; and pushing the item through the cutter and removable insert, thereby sectioning the item with the sectioning device.

According to other aspects illustrated herein, there is provided a method for modifying a sectioning device to section items of different shapes, the method comprising: positioning a cutter between an opening of a cutter deck and a press assembly of a sectioning device, the cutter adapted to section a first fruit by pushing the first fruit through the cutter; and sectioning a second fruit shaped differently from the first fruit by removing the cutter and positioning a removable insert between the opening of the cutter deck and a second cutter, thereby modifying the sectioning device to section items of different shapes.

The above described and other features are exemplified by the following figures and detailed description.

BRIEF DESCRIPTION OF THE DRAWINGS

Referring now to the Figures, which are exemplary embodiments.

DETAILED DESCRIPTION

Figure 1:
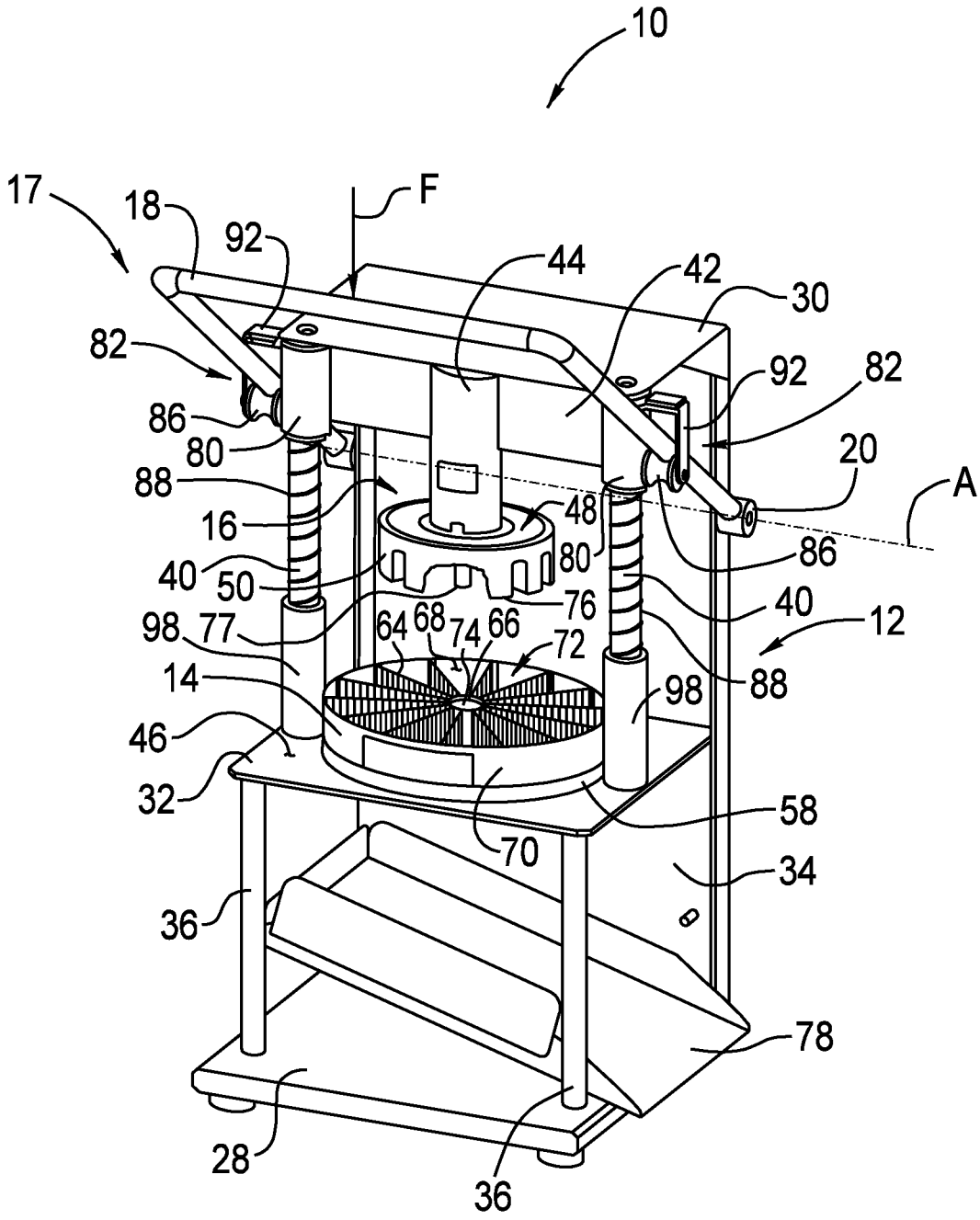
FIG. 1 is a front perspective view of a sectioning device with a handle.

As shown in FIG. 1, a sectioning device 10 may be utilized for sectioning food and other items such as, for example, fruits such as melons, pears, pineapples, apples; vegetables such as eggplant and zucchini; breads and doughs; and non-food items such as wood, plastic and rigid foam. The sectioning device 10 includes a frame 12 and a cutter 14 removably positioned on the frame. The sectioning device 10 also includes a press assembly 16 movably positioned on the frame 10 and an activator 17. The activator 17 activates the press assembly 16 to push an item (shown and described below) to be sectioned against and through the cutter 14.

In one embodiment, the activator 17 includes a handle 18 pivotally coupled to the frame 10 for movement between a neutral position and a sectioning position. Movement of the handle 18 causes the press assembly to move between the neutral position and the sectioning position.

The device 10 is configured so that the above-described movement of the press assembly 16 between the neutral and sectioning positions can be accomplished in one smooth continuous motion. In one embodiment, the device 10 is configured so that an item to be sectioned is placed between the press assembly 16 and the cutter 14 and pushed through the cutter, thereby causing the entirety of the item to be sectioned.

As shown in FIG. 1, the handle 18 is generally u-shaped and is pivotally coupled at two generally opposing positions to the frame 12 thereby causing the handle to be rotatable about a pivot axis A. In one embodiment, a portion of the handle 18 slidably engages the press assembly 16 to effect movement thereof between the neutral and sectioning positions.

While a u-shaped handle 18 is shown and described, it is contemplated that other handle shapes and configurations can be employed without departing from the broader aspects of the sectioning device 10. Moreover, while the handle 18 has been shown and described as being pivotably attached to the frame at two generally opposing points 20, it is contemplated that a single pivot location may be employed. Moreover, mechanisms of the activator 17 for moving the press assembly 16, other than the handle 18, and/or movement of the cutter 14 between the neutral position and the sectioning position can be employed, including, but not limited to, motors, steppers motors, pneumatic cylinders, diaphragm actuators, lead screws, rack and pinions, belt drives and cam mechanisms.

Figure 2:
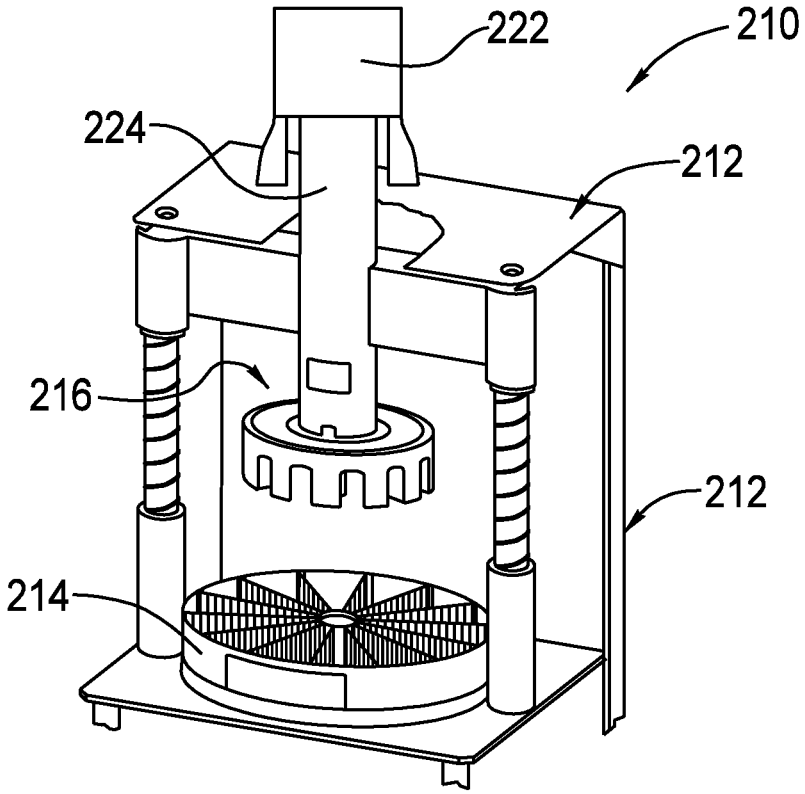
FIG. 2 is a front perspective view of a portion of the sectioning device of FIG. 1 including a pneumatic cylinder.

The sectioning device of FIG. 2 is similar to that illustrated in FIG. 1. Therefore, like elements will be given like numbers preceded by the numeral 2. Referring to FIG. 2, a sectioning device for sectioning food and other items is generally designated by the reference number 210. The sectioning device 210 includes a frame 212 and a cutter 214 removably positioned on the frame. A press assembly 216 is movably positioned on the frame 212 for pushing an item to be sectioned against and through the cutter 214.

The sectioning device 210 includes a pneumatic cylinder 222 mounted on the frame 212. The pneumatic cylinder 222 includes a shaft 224 moveable between an extended position and a retracted position. The extended position of the shaft 224 corresponds to the above-described sectioning position, while the retracted position of the shaft corresponds to the above-described neutral position. The pneumatic cylinder 222 is controlled via the introduction of pressurized gas from a gas source, such as, for example, a compressed air container (not shown). A valve or other actuator (not shown) can also be employed to operate the cylinder. While a pneumatic cylinder has been described, the sectioning device 210 is not limited in this regard as it is within the scope of the present disclosure to employ a hydraulic cylinder and liquid source.

Referring back to FIG. 1, the frame 12 can be manufactured from a substantially rigid material such as metal and includes a base 28, a cover plate 30 and a cutter deck 32 positioned between the base and the cover plate. While the device 10 may be manufactured to any dimension requested by a user, it is contemplated that the cutter deck 32 have a dimension that is adaptable to hold items of various sizes that are placed thereon.

In one embodiment, the cutter deck 32 has a generally square shape, wherein each of the four sides has a length between about 10 inches to about 20 inches. In another embodiment, each of the four sides of the generally square shaped cutter deck 32 has a length between about 12 inches to about 15 inches. In a further embodiment, two opposing sides of the generally square shaped cutter deck 32 are between about 12.5 inches and about 13.0 inches while the remaining two opposing sides of the generally square shaped cutter deck are between about 13 inches and about 14 inches.

The frame 12 also includes a backing plate 34. The base 28, the cover plate 30 and the cutter deck 32 are mounted to the backing plate 34 and in the illustrated embodiment are substantially perpendicular thereto. One or more legs 36 extend between the cutter deck 32 and the base 28. The frame 12 further includes one or more guide posts 40 each coupled to the cover plate 30 at one end and to the cutter deck 32 at a generally opposite end. The press assembly 16 includes a support 42 extending between the guide posts 40 and engaged with the guide posts and a cylindrical press shaft 44 which is removably mounted to the support 42. A press module 48 is removably mounted to the press shaft 44. A detent mechanism (not shown) may be employed to retain the press module on the support.

In one embodiment, the press module 48 is removable with respect to the item being sectioned. For example, if the item to be sectioned is a pineapple, in a lengthwise position, the press module 48 roughly corresponds to the diameter of the pineapple. However, if a melon is to be sectioned, the press module 48 can be interchanged with a press module that is wider in diameter to roughly match the diameter of the melon. While pineapples and melons are discussed, these food items are merely examples of items that may be sectioned by the device. Moreover, it is contemplated that the press module 48 may have other shapes or sizes as shown and described herein and as would be known to those skilled in the art to accommodate sectioning items of interest.

While the press module 48 has been described as being removably mounted to the press shaft 44, the sectioning device 10 is not limited in this regard as the press module can also be integral with the press shaft.

While the sectioning device 10 is shown as including the frame 12 having the base 28, the cover plate 30, the cutter deck 32 and the backing plate 34, the sectioning device is not limited in this regard as other suitable frame configurations may be employed without departing from the broader aspects of the sectioning device including but not limited to configurations having any number of extensions secured to the base; a one piece molded structure; a structure including components adhesively secured, welded and/or brazed to one another; a collapsible structure; a frame having a splash guard, dust cover and/or safety shield; and a structure comprised of modular components interchangeable with other devices.

While the frame 12 has been described as being manufactured from metal, the sectioning device 10 is not limited in this regard as other materials including plastic, wood and composite materials are also contemplated. While the base 28, the cover plate 30 and the cutter deck 32 are shown stacked substantially parallel to one another with the backing plate 34 substantially perpendicular thereto, the sectioning device 10 is not limited in this regard as the base 28, the cover plate 30, the cutter deck 32 and the backing plate 34 can be configured in other suitable orientations without departing from the broader aspects of the sectioning device.

Figure 3:
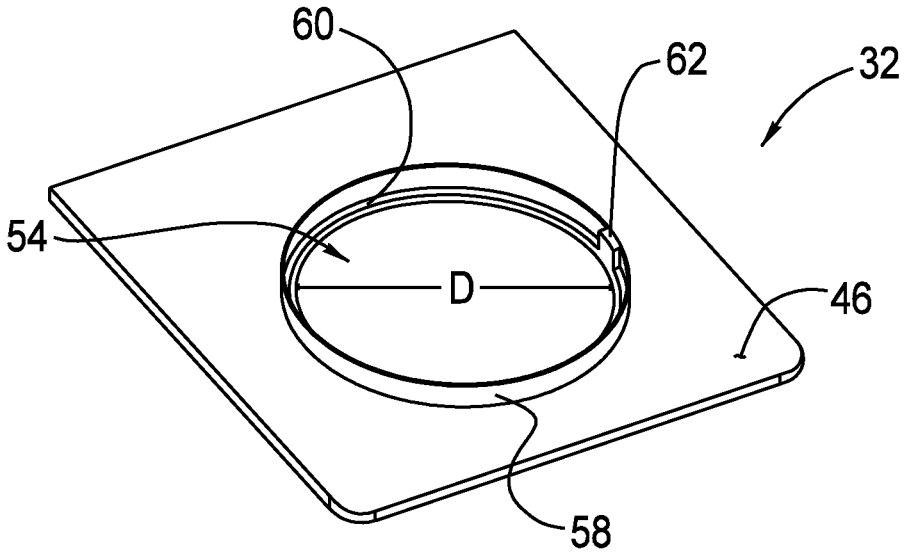
FIG. 3 is a top perspective view of a cutter deck.

As shown in FIGS. 1 and 3 the cutter deck 32 has a substantially circular opening 54 disposed therethrough. An annular ring 58 is positioned on the cutter deck 32, concentrically with the opening 54 and forming a lip 60 on the cutter deck 32 for removably supporting the cutter 14. A key 62 is fixed to an inner circumference of the ring 58 and the lip 60 for alignment with a notch (described below) of the cutter 14.

The diameter D of the circular opening 54 may vary depending on the size of the device 10. In one embodiment, the circular opening 54 has a diameter D of between about 8 inches to about 13 inches. In another embodiment, the circular opening 54 has a diameter D of between about 9 inches to about 12 inches.

Figure 3B:
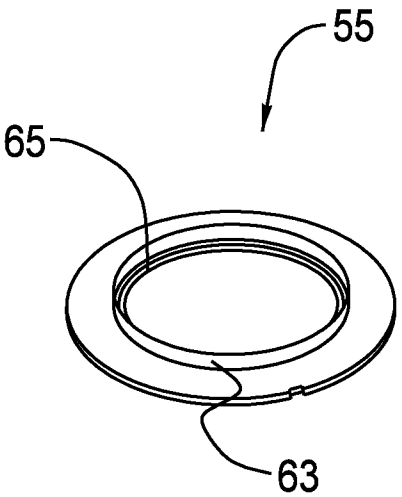
FIGS. 3A-B illustrates several views of a removable insert.
Figure 3A:
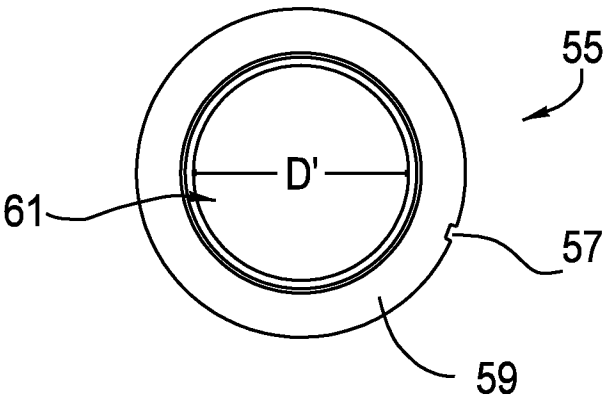

In one embodiment, the diameter D of the circular opening 54 can be reduced in size to accommodate different or smaller shaped items, thus modifying the sectioning device 10 to section different items, such as, for example, different shapes and sizes of fruit. Modification of the sectioning device 10 and the reduction of the diameter D of the circular opening 54 may be accomplished by positioning a removable insert 55, as shown in FIGS. 3A and 3B, within the opening 54. In one embodiment, the removable insert 55 is positioned on top of the lip 60 of the cutter deck 32.

The removable insert 55 has an opening 61 disposed therethrough. In one embodiment as shown in FIGS. 3A and 3B, the opening 61 is circular. The removable insert 55 is not limited in this regard as the opening 61 may be another shape, including, but not limited to, square, oval, and the like. The removable insert 55 is positioned on top of the lip 60 such that the opening 61 is concentrically aligned with the opening 54.

The removable insert 55 has a notch 57 on an outside rim 59 that mates with the key 62 to align and secure the removable insert 55 on the lip 60. The opening 61 of the removable insert 55 has a diameter D' that is smaller than the diameter D of the circular opening 54. In one embodiment, the diameter D' of the opening 57 may be between about 3 inches to about 8 inches. As shown in FIG. 3B, the removable insert 55 may have a raised annular ring 63 that forms a lip 65.

Figure 3D:
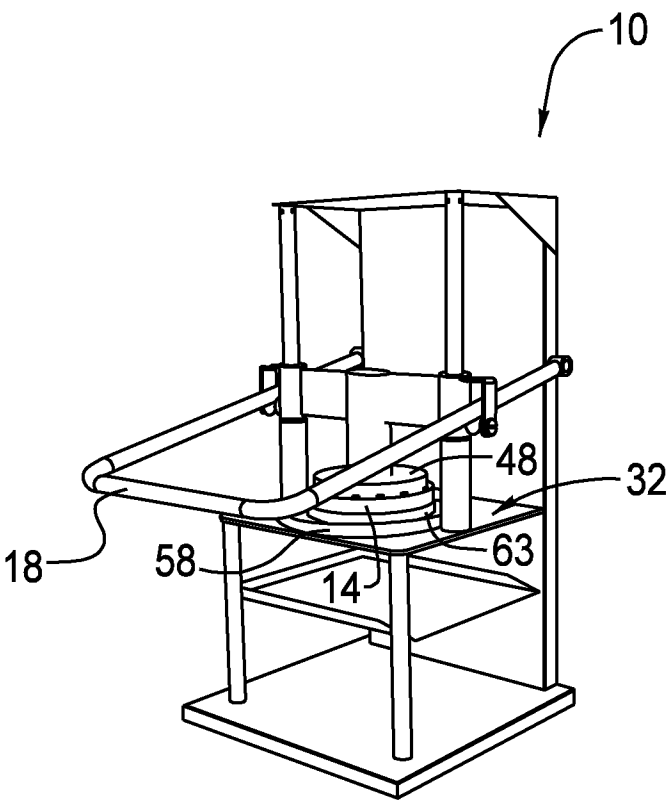
Figure 3C:
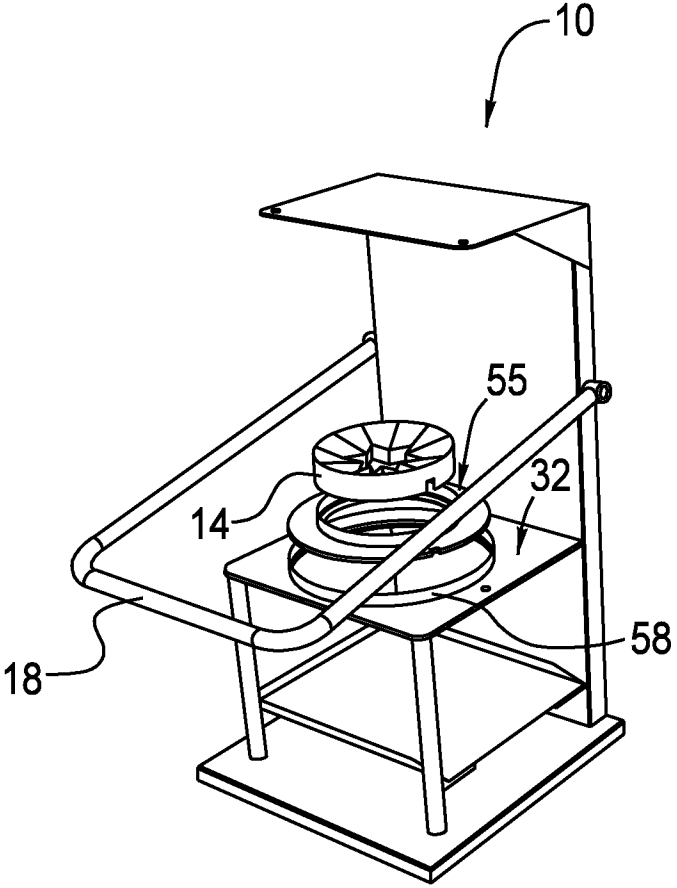

FIG. 3C is a partially exploded assembly view illustrating the positioning of the removable insert 55 on the cutter deck 32 and specifically the positioning of the removable insert and the positioning of the cutter 14. In one embodiment, the removable insert 55 is adapted to have the cutter 14 positioned on the lip 65. The cutter 14 used with the removable insert 55 is typically smaller in diameter than a cutter utilized only with the annular ring 58 on the cutter deck 32, e.g., when the removable insert is not placed on the cutter deck.

FIG. 3D illustrates the device 10 with the handle 18 in a position such that the press module 48 is in a sectioning position, e.g., moved in a manner to force an item through the cutter 14, the opening 61 of the removable insert 55 and the opening 54 of the cutter deck 32.

Referring back to FIG. 1, the cutter 14 is shown having twelve blades 64 extending radially outward from a circular cutting blade 66 and terminating at and being secured to an inside surface 68 of a retaining ring 70, creating twelve wedge shaped voids 72 and one circular void 74 in the cutter 14. The press module 48 has a contoured form 50, the shape and size of which is complementary to the shape and size of the cutter 14 and the item to be sectioned. Accordingly, the contoured form 50 includes twelve wedge shaped fingers 76 which are complementary to the shape and size of the voids 72. In addition, the contoured form 50 is illustrated with a portion thereof cut away thereby showing one circular finger 77 which corresponds in size and shape to the circular void 74. The wedge shaped fingers 76 and the circular finger 77 are in the form of segmented protrusions extending from the contoured form 50.

As the press assembly 16 is moved from the neutral position to the sectioning position, the wedge shaped fingers 76 are inserted into the voids 72 and the circular finger 77 is inserted into the circular void 74, thereby forcing an item placed between the cutter 14 and the press module 48, through the cutter and the opening 54 of the cutter deck 32 in a single continuous motion.

In one embodiment, the sectioning device 10 may also include a receptacle 78 removably secured to the frame 12. The receptacle 78 is positioned to receive sectioned items. In one embodiment, as shown in FIG. 1, the receptacle 78 is a chute, or a ramp having a sloping channel through which the sectioned item may descend in a direction away from the cutter 14. The receptacle 78 is not limited in this regard as the receptacle may be, for example, a bowl, a flat surface or the like.

The receptacle 78 may be positioned in a manner such that the sectioned items are conveyed to a counter top, a belt conveyer, a scoop, a rotary conveyor, an air and/or vacuum conveyer, or the like.

Figure 4A:
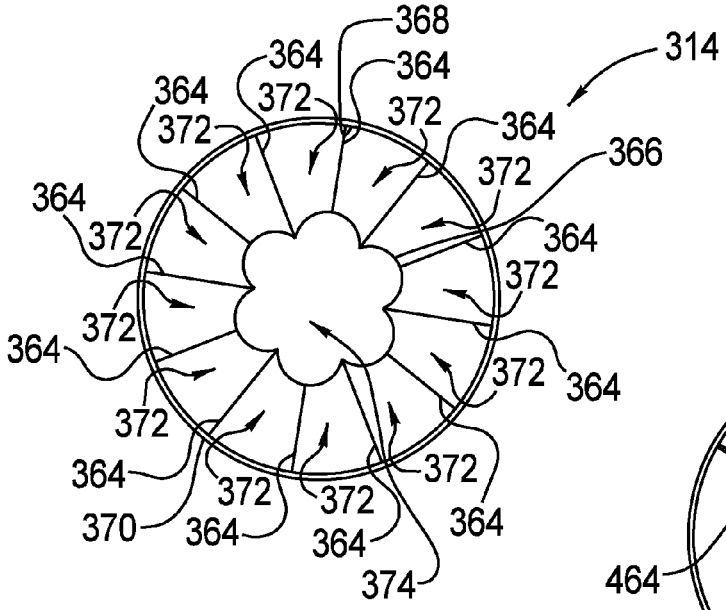
FIG. 4A is a top view of a floral pattern cutter.

The cutter illustrated in FIG. 4A is similar to that illustrated in FIG. 1. Therefore, like elements will be given like numbers preceded by the numeral 3. Referring to FIG. 4A, the cutter 314 is shown having twelve blades 364 extending radially outward from a floral pattern cutting blade 366 and terminating at and being secured to an inside surface 368 of a retaining ring 370, creating twelve wedge shaped voids 372 and one floral pattern void 374 in the cutter 314. The press module (not shown) has a lower contoured form (not shown), the shape and size of which is complementary to the shape and size of the cutter 314. For example, the lowered contoured form includes wedge shaped fingers and a central floral pattern finger complementary to the cutter 314 forcing an item placed between the press module and the cutter in a single continuous motion.

Figure 4B:
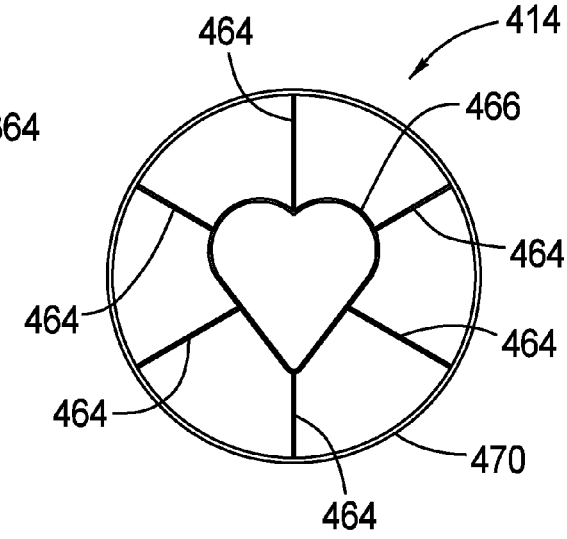
FIG. 4B is a top view of a cutter with a heart shaped pattern.

It should be appreciated that while twelve blades 64, 364 are shown with one circular pattern cutting blade 66 (or a floral pattern cutting blade 366), the sectioning device 10 is not limited in this regard as various different shapes, sizes and number of blades as well as the orientation and/or disposition of the blades may be employed without departing from the broader aspects of the sectioning device. It should also be appreciated that while the cutter 14 and 314 are shown having a circular shape retaining ring 70, 370, other shapes may also be used depending upon the particular application. For example, a cutter 414 illustrated in FIG. 4B having six blades 464 extending radially outward from a heart shaped cutting blade 466 and terminating at and being secured to an inside surface of a retaining ring 470 can also be employed.

Figure 5:
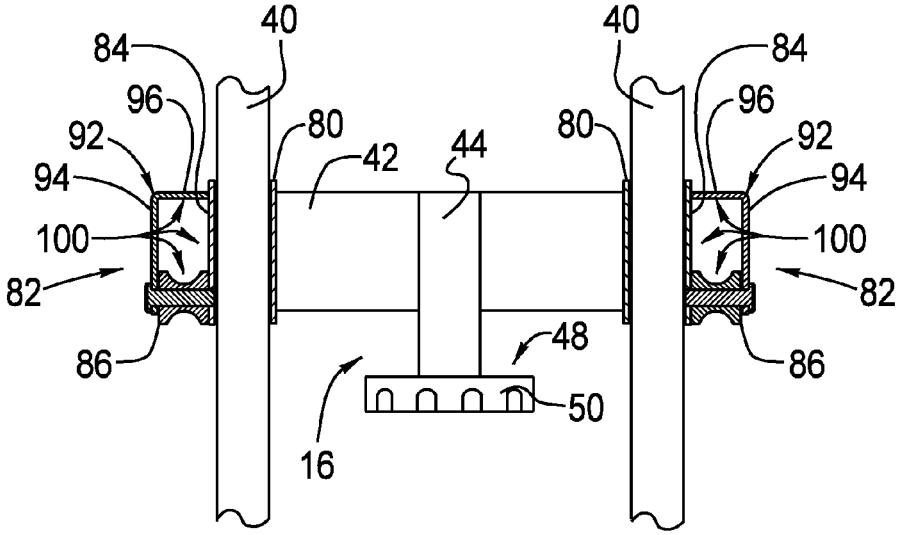
FIG. 5 is a front partial cross sectional view of the support and a portion of the sectioning device.

Referring to FIGS. 1 and 5, the support 42 includes a substantially cylindrical sleeve 80 secured to opposing ends thereof and in sliding engagement with respective guide posts 40. A roller assembly 82 is positioned on an outwardly facing portion 84 of each of the cylindrical sleeves 80. The roller assemblies 82 each include a roller 86 rotatably mounted on the sleeve 80 with a suitable fastener. Each of the roller assemblies 82 also includes an L-shaped stop plate 92 having a first section 94 and a second section 96 arranged substantially perpendicular to one another and positioned on the cylindrical sleeve 80 with a suitable fastener. Collectively, the roller 86, the stop plate 92 and the cylindrical sleeve 80 define a boundary 100 which limits extraneous movement of the handle 18.

While the roller assembly 82 is described as having roller 86 and a stop plate 92, the sectioning device 10 is not limited in this regard as other means of providing sliding engagement between the handle 18 and portions of the press assembly 16, including but not limited to direct sliding contact between the handle and a portion of the press assembly, the use of sleeves and the use of roller bearing assemblies, can be employed without departing from the broader aspects of the sectioning device.

Figure 6A:
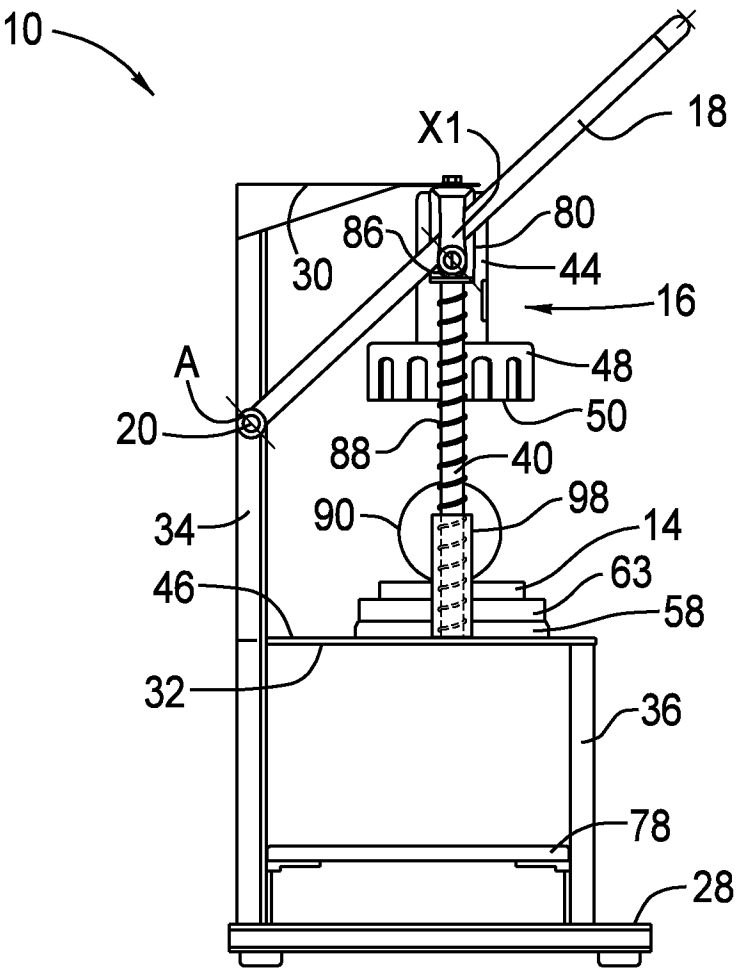
FIGS. 6A, 7 and 7A are side views of the sectioning device in a sectioning position.
Figure 6:
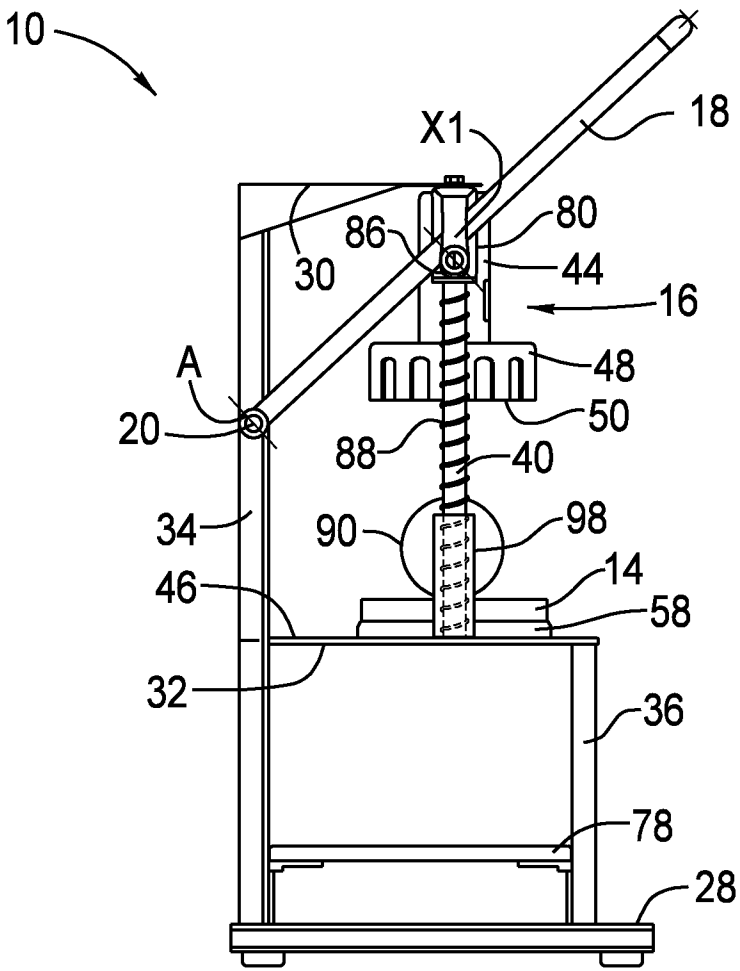
FIG. 6 is a side view of the sectioning device in a neutral position.
Figure 7A:
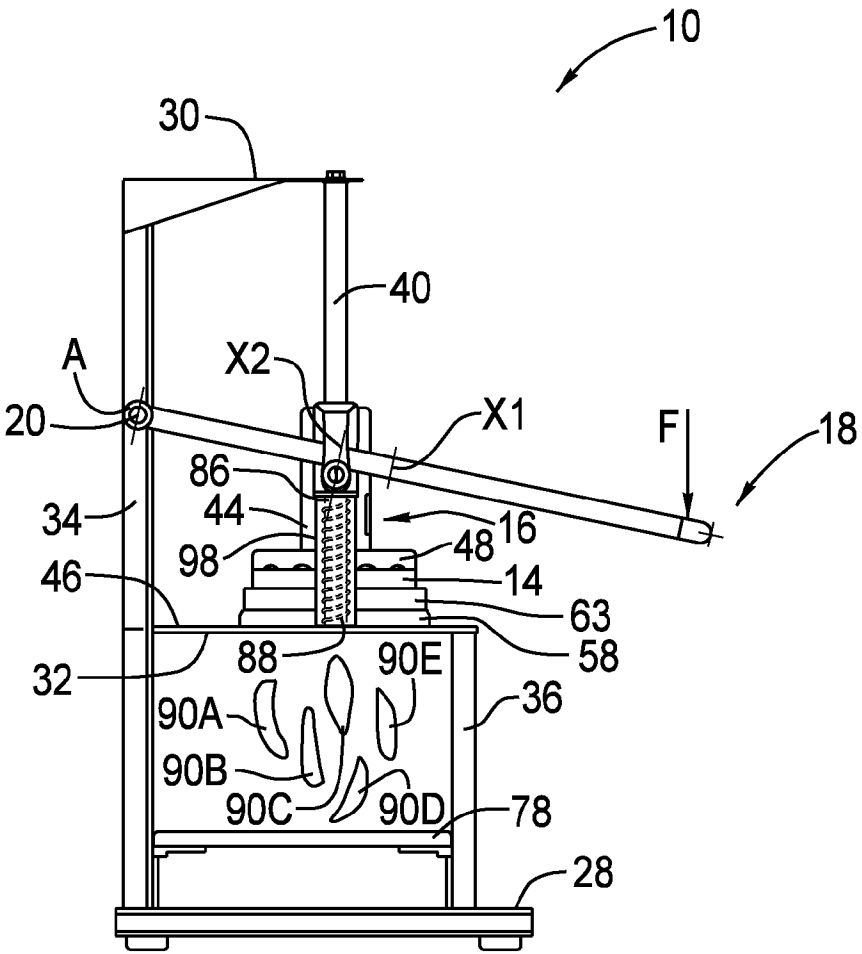
Figure 7:
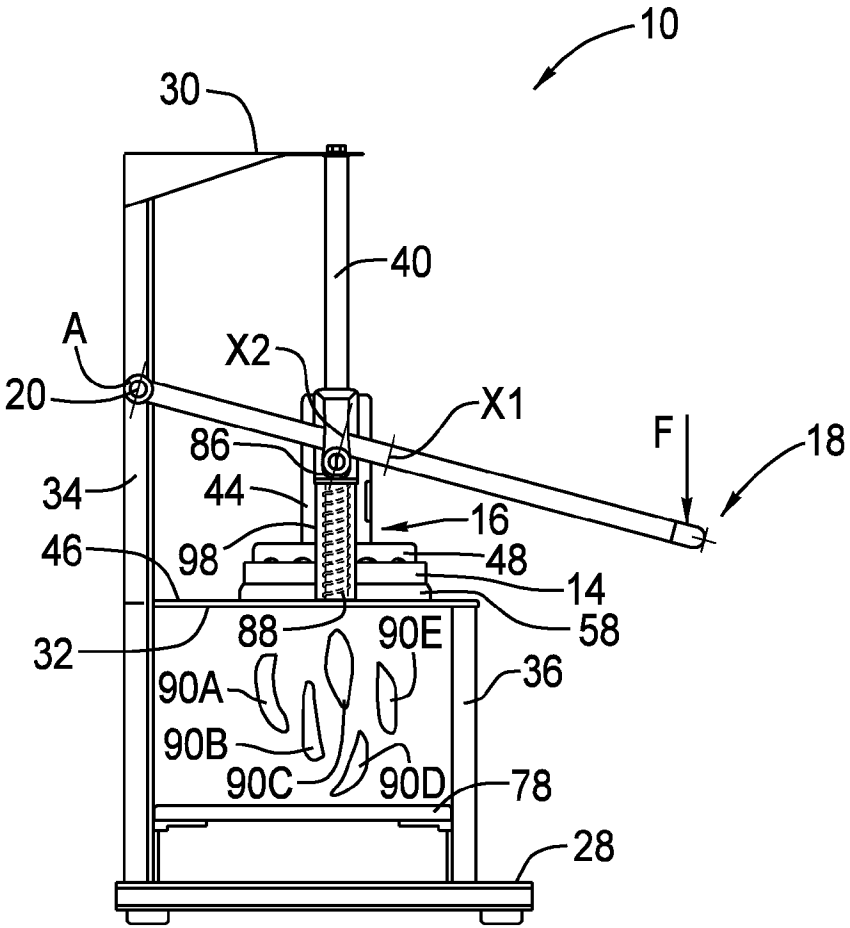

Referring to FIG. 6, during operation of the sectioning device 10, an item to be sectioned 90 is placed between the cutter 14 and the press module 48. The press assembly 16 moves in a single continuous motion between a neutral position as shown in FIG. 6 and a sectioning position as shown in FIG. 7, in response to a generally downward force F applied to the handle 18. During the sectioning operation, the item 90 to be sectioned is pushed through the cutter 14 by the press module 48, thereby causing the entirety of the item to be sectioned into sections 90A-E.

As illustrated in FIG. 6, in one embodiment, the press assembly 16 is normally urged toward the neutral position by a coil spring 88 wrapped around and slidably mounted on the each of the guide posts 40. A portion of each of the springs 88 is disposed within respective stopper sleeves 98 which are coaxial with the respective guide posts 40 and the springs 88. The stopper sleeves 98 are secured to respective portions of the top side 46 of the cutter deck 32 and limit travel of the press assembly 16.

As the handle 18 moves between the neutral position and the sectioning position, an area of engagement between the handle and the roller 86 moves between points X1 and X2. Accordingly, the mechanical advantage imparted by the handle 18 onto the press assembly 16, increases as the area of engagement moves away from the pivot axis A (i.e., from point X1 to X2).

While the coil spring 88 is the to urge the press assembly towards the neutral position, the sectioning device is not limited in this regard as other biasing means can be adopted including but not limited to the use of any number of coil springs, leaf springs, torsion springs, rubber, elastomeric materials, pneumatic devices and any combination thereof.

While the downward motion of the handle 18 is the to cause the press assembly 16 to move towards the cutter 14, the sectioning device 10 is not limited in this regard as other configurations are also suitable including but not limited to having the cutter 14 move towards a stationary press assembly and having both the cutter and the press assembly move towards each other.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description.

What is claimed is:

1. A sectioning device comprising;

a frame;

a cutting deck mounted on the frame, a first cutter adapted for being removably carried by said cutting deck;

the cutting deck having an aperture and a first alignment mechanism for guiding the positioning of said first cutter with respect to a predetermined location along the inner circumference of said aperture;

a removable insert having an interior defining an opening, the removable insert positioned such that the opening of the removable insert and the aperture of the cutting deck are in communication enabling an item to be passed through said opening of the removable insert and said aperture of the cutting deck, the removable insert further having a second alignment mechanism;

a second cutter adapted for being removably carried by said removable insert;

a press assembly positioned on the frame adapted for pushing an item against and through either said first or said second cutter;

an activator moving the press assembly between a neutral position and a sectioning position in a single continuous motion, the press assembly and either said first or second cutter configured such that the item is sectioned upon movement of the press assembly from the neutral position to the sectioning position;

wherein said first cutter comprises a plurality of blades defining a first plurality of voids therebetween and a third alignment mechanism, and said second cutter comprises a plurality of blades defining a second plurality of voids of different configuration than said first cutter;

wherein the third alignment mechanism cooperates with the first alignment mechanism for aligning said first cutter having the first plurality of voids in position within the aperture of said cutting deck, and said press assembly includes a first press module having a plurality of fingers in position with said press assembly such that said fingers of said first press module are in position for being received within said first plurality of voids of said first cutter when said activator moves said press assembly between said neutral and sectioning position; and wherein said second cutter having the second plurality of voids is positioned within said opening of the removable insert and said press assembly includes a second press module having a second plurality of fingers in position with said press assembly such that said fingers of said second press module are in position for being received within said second plurality of voids of said second cutter when said activator moves the press assembly between said neutral and sectioning position; and wherein the second alignment mechanism cooperates with the first alignment mechanism for aligning the removable insert in the aperture of the cutting deck.

2. A sectioning device according to claim 1, wherein the press assembly includes a support movably positioned on the frame and a press module removably positioned on the support.

3. The sectioning device of claim 1 wherein said first and second alignment mechanisms include a notch and an associated key configured for being received within said notch.

4. The sectioning device of claim 1 wherein said first and third alignment mechanism includes a notch and an associated key configured for being received within said notch.

* * * * *